US011848517B2

(12) United States Patent
Wu

(10) Patent No.: US 11,848,517 B2
(45) Date of Patent: Dec. 19, 2023

(54) TERMINAL BLOCK STRUCTURE AND UNBUCKLING UNIT THEREOF

(71) Applicants: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

( * ) Notice: Subject to any disclaimer, the term of this patent is extended or adjusted under 35 U.S.C. 154(b) by 0 days.

(21) Appl. No.: 17/718,032

(22) Filed: Apr. 11, 2022

(65) Prior Publication Data

US 2023/0327373 A1 Oct. 12, 2023

(51) Int. Cl.

| | |
|---|---|
| ***H01R 13/62*** | (2006.01) |
| ***H01R 13/627*** | (2006.01) |
| *H01R 9/24* | (2006.01) |

(52) U.S. Cl.

CPC ..... *H01R 13/6275* (2013.01); *H01R 9/2491* (2013.01)

(58) Field of Classification Search

CPC ..... H01R 13/6275; H01R 9/2491

See application file for complete search history.

(56) References Cited

U.S. PATENT DOCUMENTS 10,411,395 B1 * 9/2019 Wu ..... H01R 13/506
2002/0072265 A1 * 6/2002 Chen ..... H01R 13/6272 439/357

(Continued)

FOREIGN PATENT DOCUMENTS

DE 202007005300 U1 8/2008
DE 202009002159 U1 7/2010

(Continued)

OTHER PUBLICATIONS

Office Action dated Jan. 10, 2023 of the corresponding German patent application No. 102022112023.6.

*Primary Examiner* — Truc T Nguyen

(74) *Attorney, Agent, or Firm* — Chun-Ming Shih; HDLS IPR SERVICES

(57) ABSTRACT

A terminal block structure and an unbuckling unit thereof are disclosed. The unbuckling unit has a base member and a rotary member, the rotary member is connected to the base member to be operated. The rotary member includes a first arm part, a second arm part extended from the first arm part and a rotary part disposed between the first arm part and the second arm part. The second arm part has a buckling unit, and the rotary part is connected to the base member. When the first arm part is applied with an external force, the rotary member rotates about the rotary part as a rotation center to drive the second arm part to ascend. Accordingly, advantages of easily to be pressed and operated, simple in structure and convenient to be assembled are provided.

9 Claims, 11 Drawing Sheets

(56) References Cited

U.S. PATENT DOCUMENTS

| | | | | |
|---|---|---|---|---|
| 2002/0167793 | A1* | 11/2002 | Branch | H01R 13/6275 361/679.02 |
| 2017/0271815 | A1* | 9/2017 | Lane | H01R 13/6272 |
| 2018/0069347 | A1* | 3/2018 | Shimizu | H01R 13/62938 |
| 2019/0103704 | A1 | 4/2019 | Kawashima | |

FOREIGN PATENT DOCUMENTS

| | | | |
|---|---|---|---|
| DE | 102014107950 | A1 | 12/2015 |
| DE | 102016103361 | A1 | 8/2017 |
| EP | 0862244 | A1 | 9/1998 |
| FR | 2776844 | A3 | 10/1999 |
| JP | 2001167848 | A | 6/2001 |

* cited by examiner

TERMINAL BLOCK STRUCTURE AND UNBUCKLING UNIT THEREOF

BACKGROUND OF THE DISCLOSURE

Technical Field

The present disclosure relates to a technology of a terminal block structure, particularly to a terminal block structure and an unbuckling unit thereof.

Description of Related Art

A terminal block is commonly used as a connecting component, and has been widely applied in various fields requiring a massive amount of data, for example an industrial communication, an industrial equipment, an electric power industry and an industrial control. The terminal block is used for connecting two or more sets of power wires, control wires and/or data transmitting wires. For example, in an industrial controlling system, such as a power supplier, an automatic power breaking devise or a server motor driver, several or even hundreds of terminal blocks are used to achieve frequently replacing the products of different specifications with a freedom degree to coordinate the automated production and the manual production, and to achieve a proper way for producing small-scale and multiple-specifications products with high-efficiency.

A related-art terminal block has one side thereof coupled with two or more sets of power wires, control wires or data transmitting wires, another side thereof coupled with an engaging connector, and is used for transmitting signals or transferring power. However, the coupling between the terminal block and the engaging connector may be easily affected by vibrations or other reasons, thus situations of the engaging connector and the terminal block being in poor contact, loosened from each other or even released which causes circuit breaking may happen, and each node point may not normally operate.

Accordingly, the applicant of the present disclosure has devoted himself for improving the mentioned disadvantages.

SUMMARY OF THE DISCLOSURE

The present disclosure is to provide a terminal block structure and an unbuckling unit thereof, which has advantages of easily to be pressed and operated, simple in structure and convenient to be assembled.

Accordingly, the present disclosure provides a terminal block structure used to be connected to an engaging connector, the engaging connector has a buckled unit, the terminal block structure includes an insulating housing and at least one unbuckling unit, the unbuckling unit is fastened on the insulating housing, the unbuckling unit has a base member and a rotary member, the rotary member is operably connected to the base member, the rotary member includes a first arm part, a second arm part extended from the first arm part and a rotary part disposed between the first arm part and the second arm part, the second arm part has a buckling unit, and the rotary part is connected to the base member; wherein, when the first arm part is applied with an external force, the rotary member rotates about the rotary part as a rotation center to drive the second arm part to ascend to make the buckling unit and the buckled unit be unbuckled.

Accordingly, the present disclosure provides an unbuckling unit including a base member and a rotary member, the rotary member is operably connected to the base member, the rotary member includes a first arm part, a second arm part extended from the first arm part and a rotary part disposed between the first arm part and the second arm part, the second arm part has a buckling unit, and the rotary part is connected to the base member; wherein, when the first arm part is applied with an external force, the rotary member rotates about the rotary part as a rotation center to drive the second arm part to ascend.

Advantages achieved by the present disclosure are as follows. The structure is compact, the volume is small and easily to be unbuckled.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
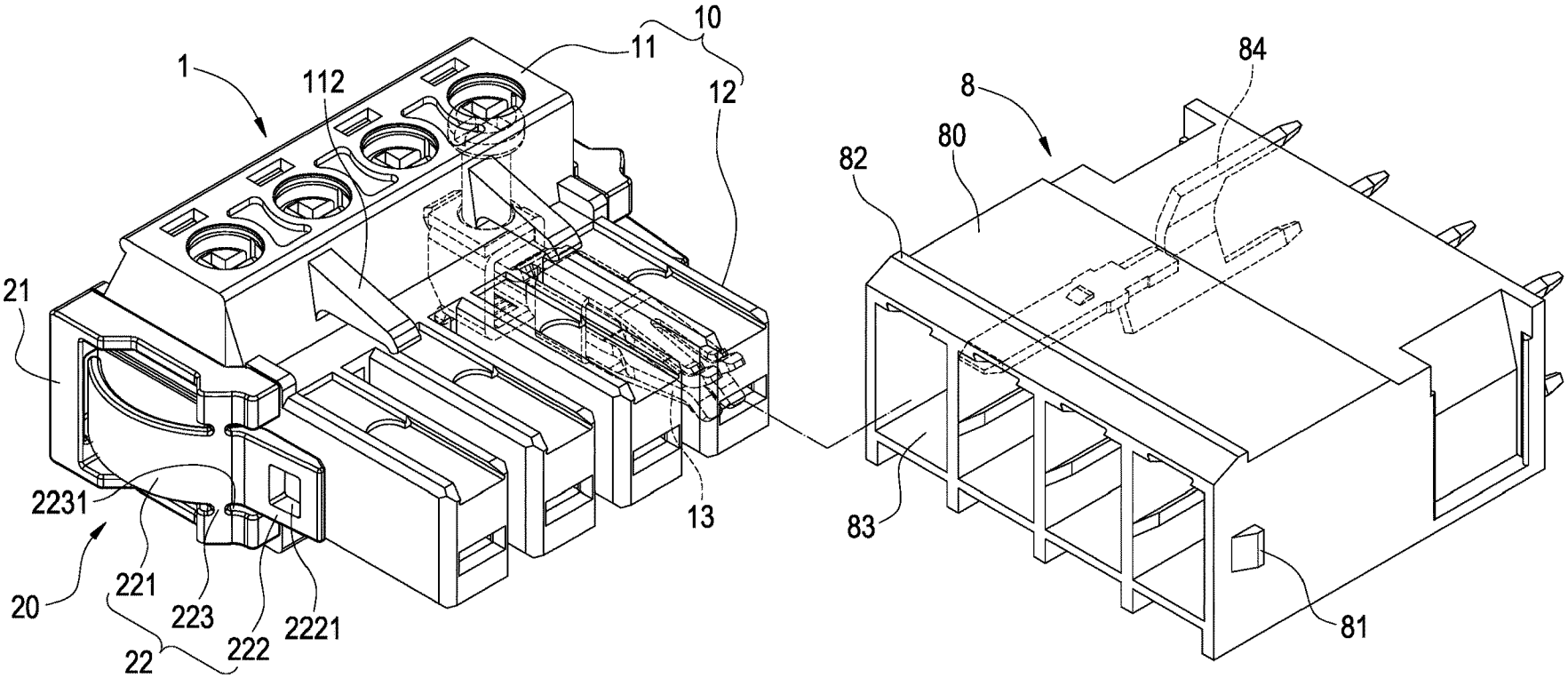
FIG. 1 is a perspective exploded view showing a terminal block structure and an engaging connector according to the present disclosure.
Figure 2:
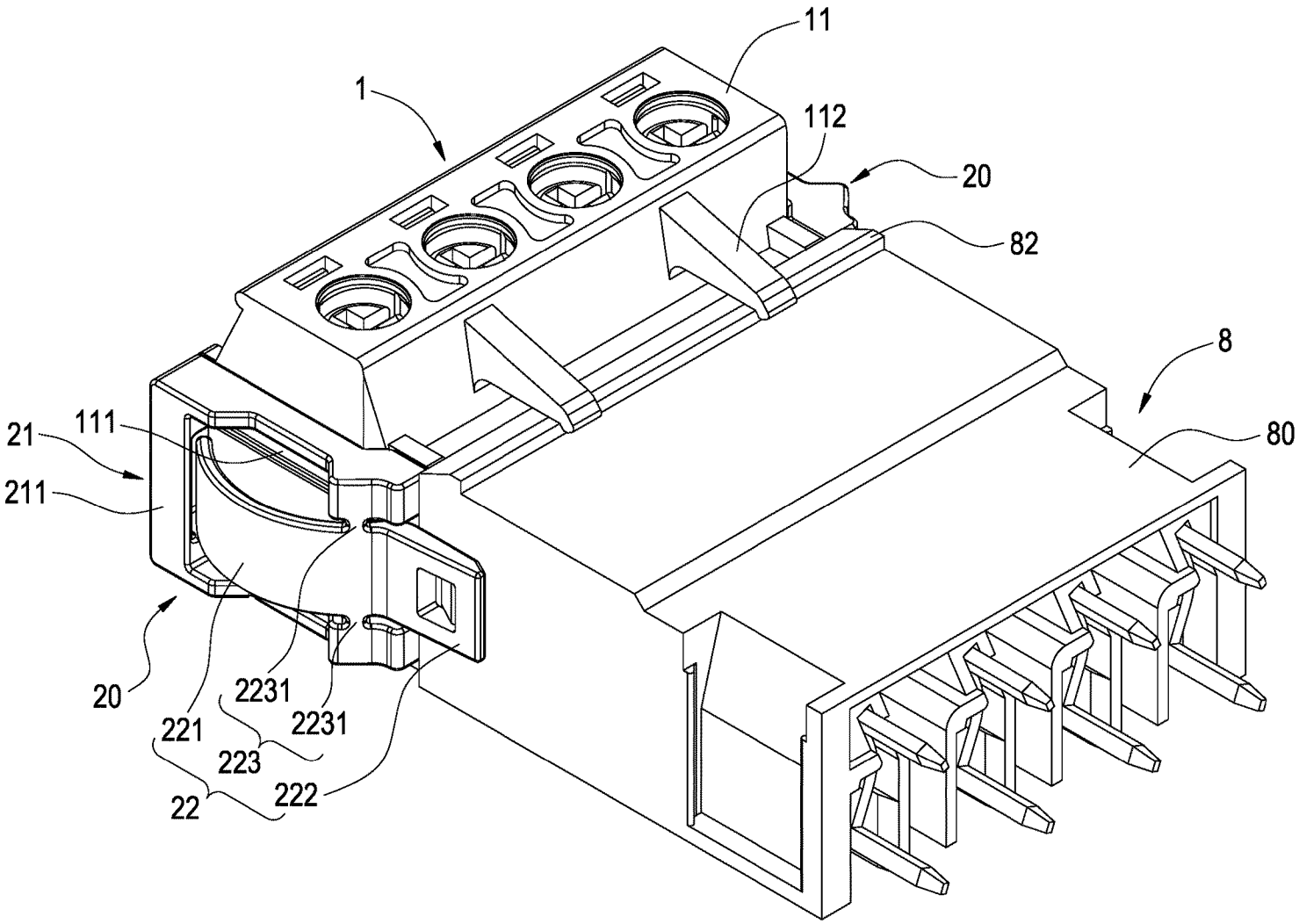
FIG. 2 is a perspective view showing the assembly of the terminal block structure and the engaging connector according to the present disclosure.
Figure 3:
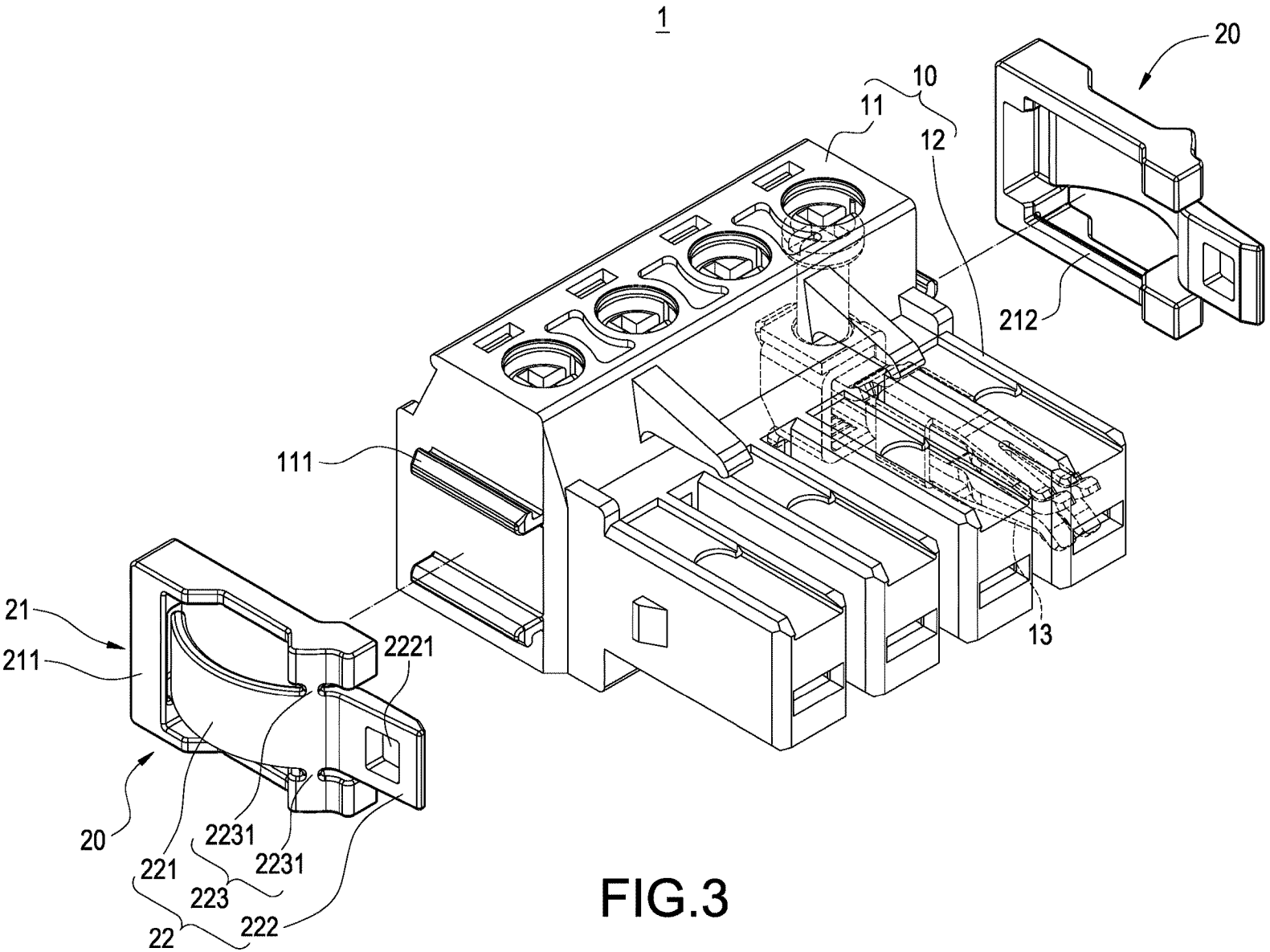
FIG. 3 is a perspective exploded view showing the terminal block structure according to the present disclosure.
Figure 4:
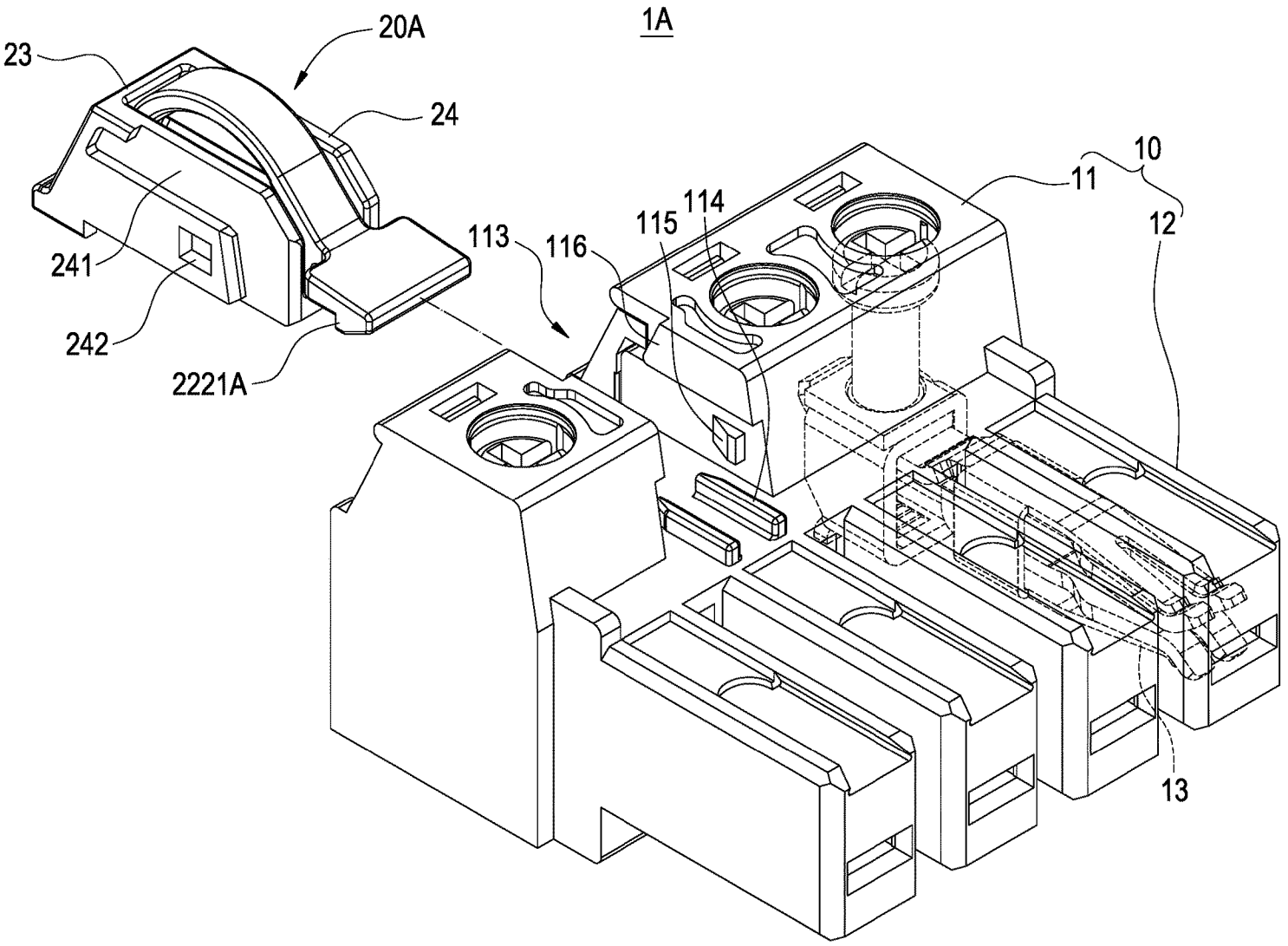
FIG. 4 is a perspective exploded view showing the terminal block structure according to another embodiment of the present disclosure.
Figure 5:
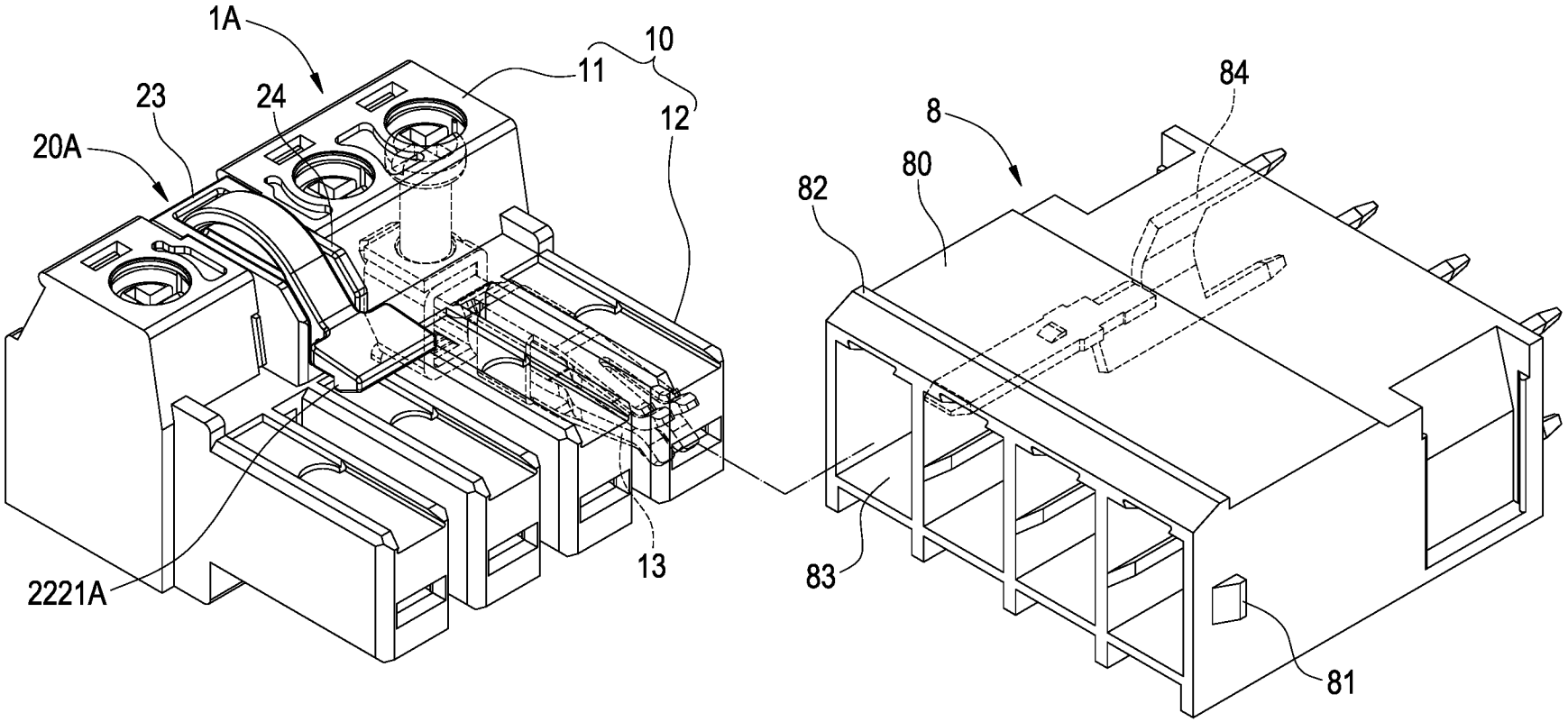
FIG. 5 is a perspective exploded view showing the terminal block structure and the engaging connector according to another embodiment of the present disclosure.
Figure 6:
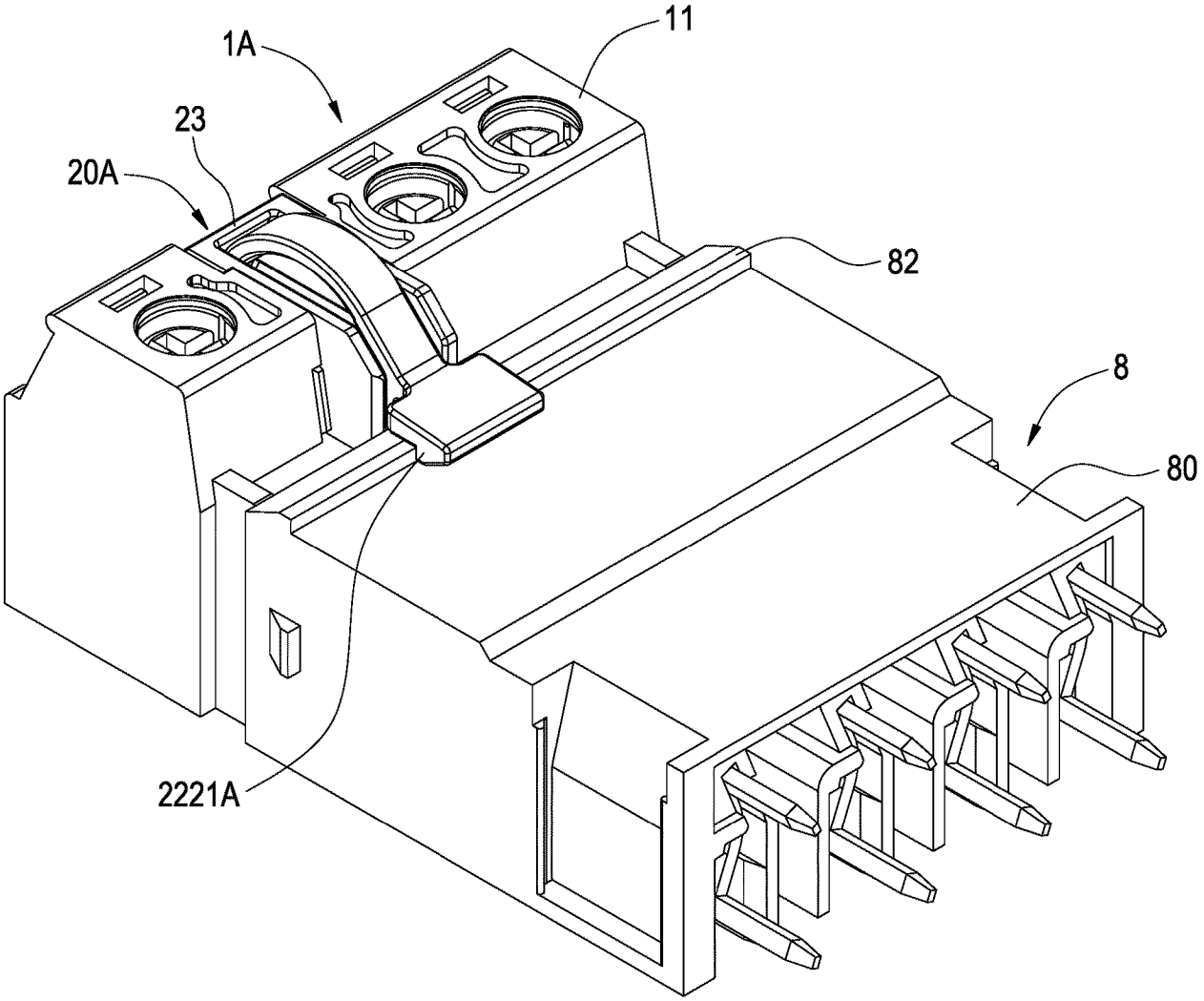
FIG. 6 is a perspective view showing the assembly of the terminal block structure and the engaging connector according to another embodiment of the present disclosure.
Figure 7:
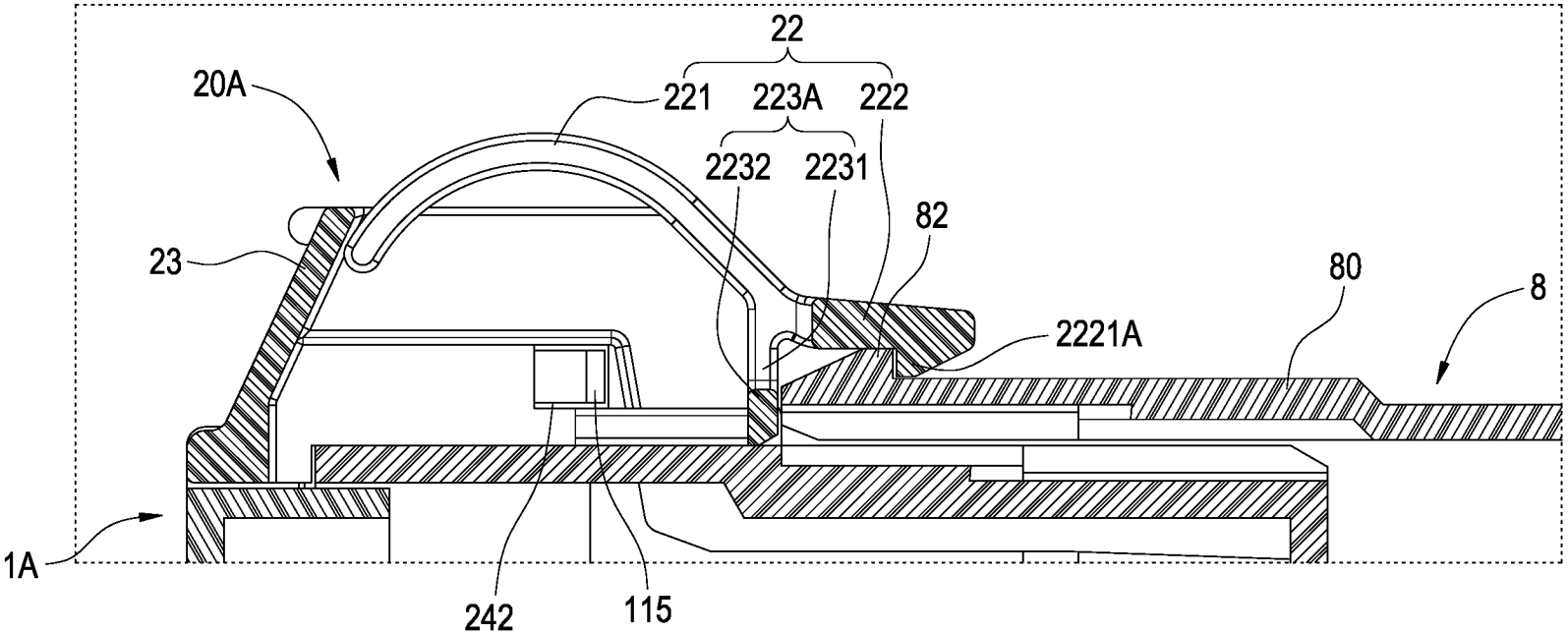
FIG. 7 is a cross sectional view showing the assembly of the terminal block structure and the engaging connector according to another embodiment of the present disclosure.

Please refer from FIG. 1 to FIG. 3, the present disclosure provides a terminal block structure, which is used for allowing an engaging connector 8 to be inserted. The engaging connector 8 has a rectangular frame body 80 and a plurality of electric conductive terminals 84. The rectangular frame body 80 is made of a material having a desirable insulating property, for example plastic. Two lateral sides of the rectangular frame body 80 are extended with a buckled unit 81. In some embodiments, the buckled unit is a trapezoid block. A top surface and a bottom surface of the rectangular frame body 80 are extended with another buckled unit 82. In some embodiments, the another buckled unit 82 is in an elongated trapezoid shape. Moreover, a plurality of insertion slots 83 are disposed in the rectangular frame body 80, and each of the electric conductive terminals 84 is disposed in each of the insertion slots 83.

In some embodiments, the terminal block structure 1 mainly includes an insulating housing 10, a pair of unbuckling units 20 and a plurality of conductive wire and terminal clipping units 13.

The insulating housing 10 mainly has a seat member 11 and a plurality of insertion blocks 12 extended from the seat member 11. The plurality of conductive wire and terminal clipping units 13 are respectively disposed in each of the insertion blocks 12. Each of the conductive wire and terminal clipping units 13 extends into the seat member 11. Each of the insertion blocks 12 is correspondingly inserted in each of the insertion slots 83. One end of each of the electric conductive terminals 84 is clipped by one end of the conductive wire and terminal clipping unit 13 to establish an electric connection. Another end of the conductive wire and terminal clipping unit 13 allows a conductive wire (not shown in figures) to be inserted and locked.

In some embodiments, a left side and a right side of the seat member 11 are extended with two buckle hooks 111 which are spaced with an interval. The seat member 11 is extended with two hook arms 112 located at one side close to the insertion block 12. The two hook arms 112 are spaced with an interval and arranged between every two of the adjacent insertion blocks 12. Each of the hook arms 112 is used for latching and positioning each of the another buckled units 82 to increase the combining stability.

Each of the unbuckling units 20 is disposed at two lateral sides of the insulating housing 10. Each of the unbuckling units 20 has a base member 21 and a rotary member 22. The rotary member 22 is operably connected to the base member 21, and the rotary member 22 and the base member 21 are integrally formed (or formed in one piece). The rotary member 22 mainly has a first arm part 221, a second arm part 222 extended from the first arm part 221 and a rotary part 223 disposed between the first arm part 221 and the second arm part 222. The first arm part 221 and the second arm part 222 are a rigid component respectively, in other words, they do not generate an elastic deformation. The second arm part 222 has a buckling unit 2221. In some embodiments, the buckling unit 2221 is a buckle slot used for allowing the buckled unit 81 to be buckled and positioned.

In some embodiments, the base member 21 has a U-shaped rack 211. Inner portions at two opposite sides of the U-shaped rack 221 are disposed with a latching strip 212. Each of the latching strips 212 is used for buckling and fastening the buckle hook 111. The first arm part 221 is an arc-shaped plate. In some embodiments, the rotary part 223 has two deformable segments 2231 formed at two lateral sides, where the first arm part 221 and the second arm part 222 are connected, and mutually connected to the U-shaped rack 211.

When the first arm part 221 is applied with an external force, the rotary member 22 rotates about each of the deformable segments 2231 of the rotary part 223 as a rotation center to drive the second arm part 222 to ascend to make the buckling unit 2221 and the buckled unit 81 be unbuckled.

Please refer from FIG. 4 to FIG. 7, which disclose another embodiment of the present disclosure. The difference between a terminal block structure 1A disclosed in the another embodiment shown from FIG. 4 to FIG. 7 and the-above-mentioned terminal block structure 1 disclosed in the embodiment shown from FIG. 1 to FIG. 3 is provided as follows. The seat member 11 has a notch 113. Two guiding strips 114, two protrusions 115 and two mounting strips 116 are disposed in the notch 113. In some embodiments, there is one unbuckling unit 20A which is disposed corresponding to the notch 113. The base member 21 of the unbuckling unit 20A mainly has a front plate 23 and a lateral plate 24 respectively connected to two ends of the front plate 23. An inner surface of each of the lateral plates 24 is correspondingly clamped and fastened with the guiding strip 114. An outer surface of each of the lateral plates 24 is disposed with a mounting slot 241 and a recessed slot 242. Each of the mounting slots 241 allows the mounting strip 116 to be accommodated, and the recessed slot 242 allows the protrusion 115 to be latched and positioned.

In some embodiments, a rotary part 223A has a deformable segment 2231 and a fixed segment 2232. The deformable segment 2231 is protruded from a junction location of the first arm part 221 and the second arm part 222. The fixed segment 2232 is connected between the deformable segment 2231 and each of the lateral plates 24, thus the rotary member 22 rotates about the rotary part 223A as a rotation center. In some embodiments, a buckling unit 2221A is a buckle block used for buckling and fastening the another buckled unit 82.

It is to be noted that the buckled unit 81 and the another buckled unit 82 may be replaced with each other, in other words, the buckling unit 2221 is buckled and fastened with the buckled unit 81, and the buckling unit 2221A is buckled and fastened with the another buckled unit 82 according to some embodiments.

Figure 8:
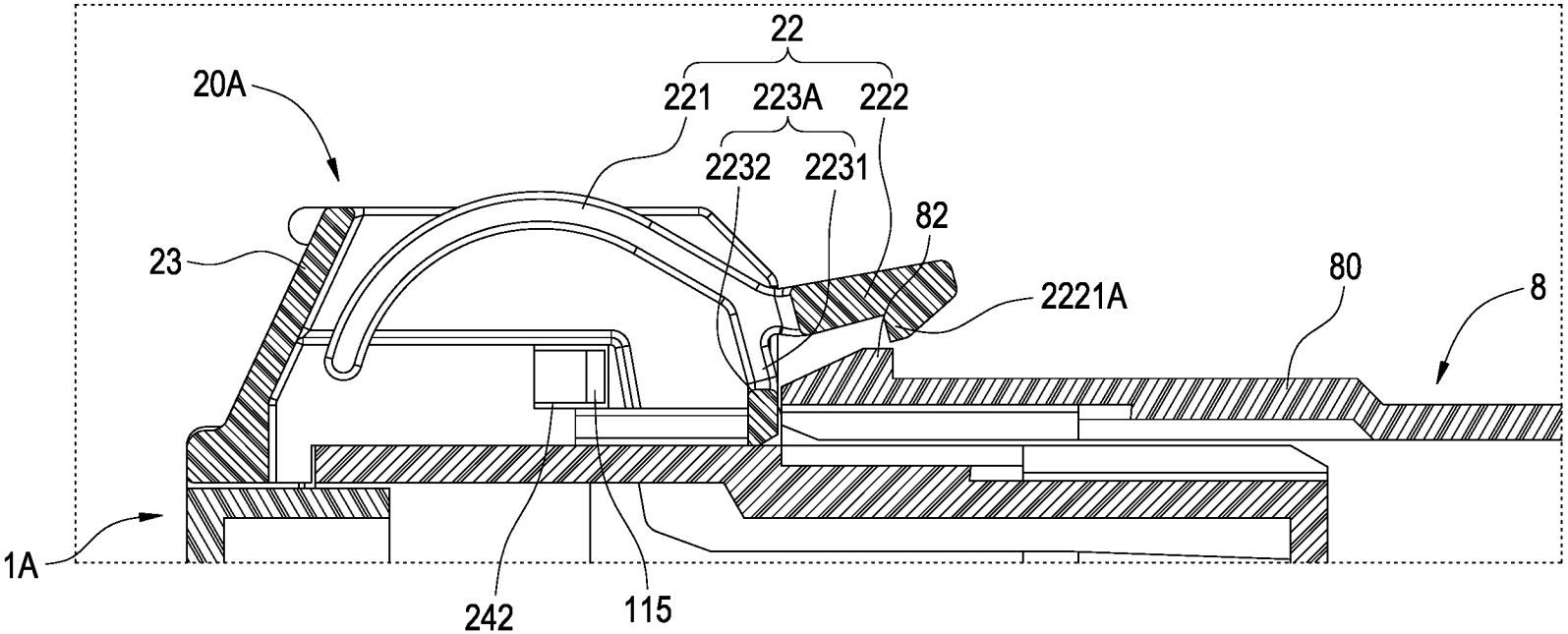
FIG. 8 is a cross sectional view showing an operating status of the terminal block structure and the engaging connector according to another embodiment of the present disclosure.
Figure 9:
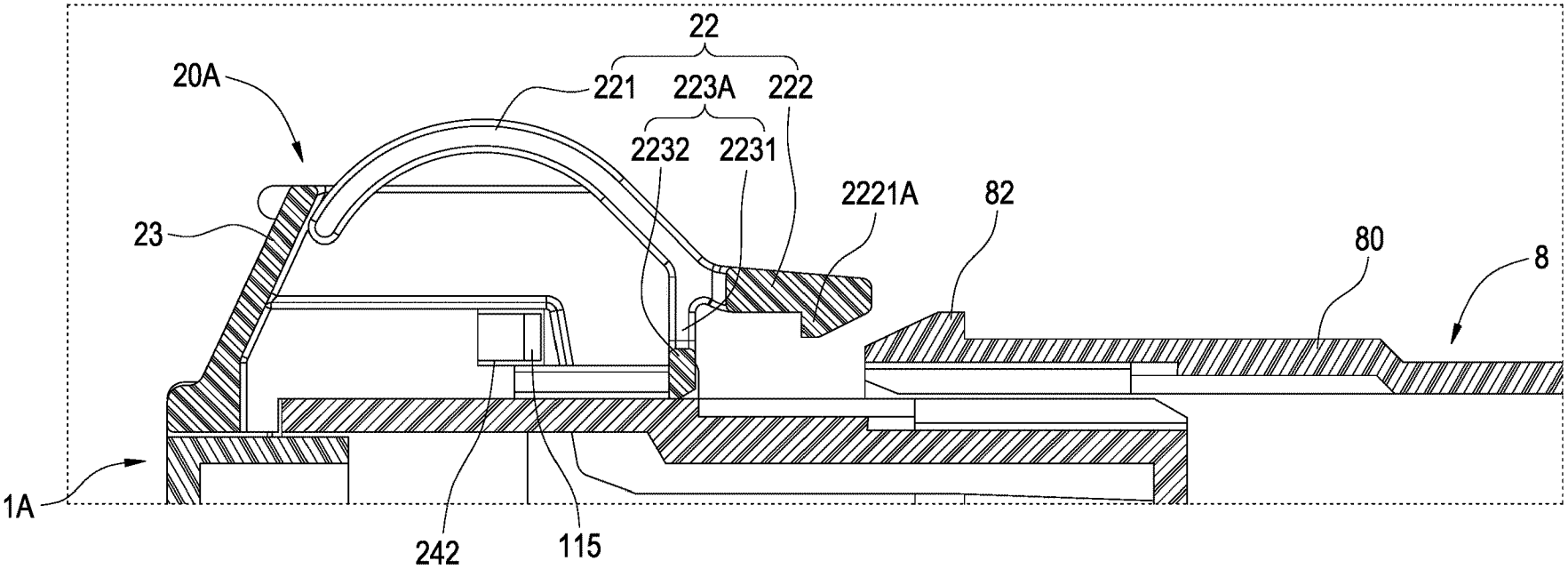
FIG. 9 is a cross sectional view showing another operating status of the terminal block structure and the engaging connector according to another embodiment of the present disclosure.

Please refer to FIG. 8 and FIG. 9, when the first arm part 221 is applied with an external force, the rotary member 22 rotates about the fixed segments 2232 of the rotary part 223A as a rotation center to drive the second arm part 222 to ascend to make the buckling unit 2221A and the another buckled unit 82 be unbuckled.

Figure 10:
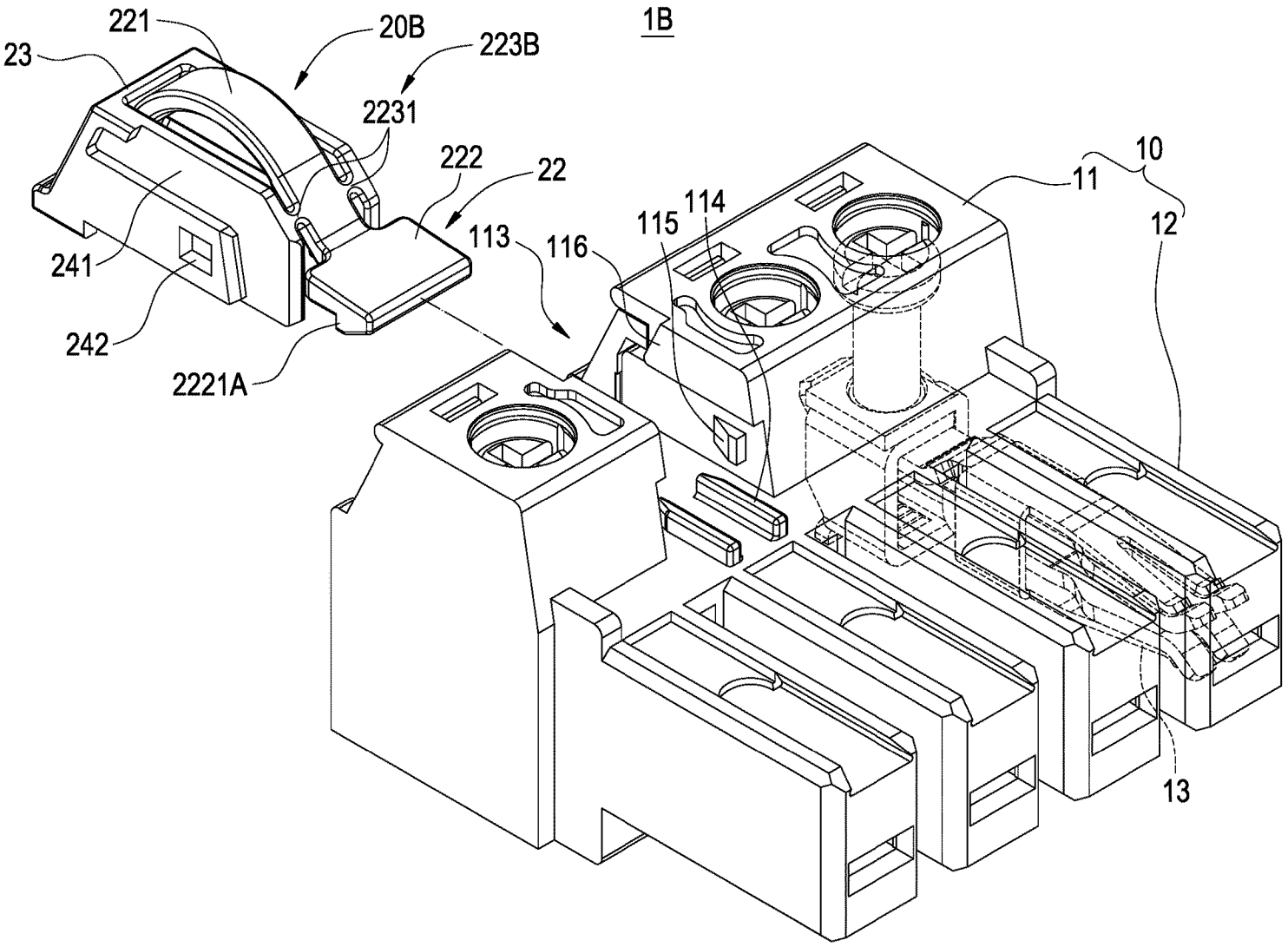
FIG. 10 is a perspective exploded view showing the terminal block structure and the engaging connector according to one another embodiment of the present disclosure.
Figure 11:
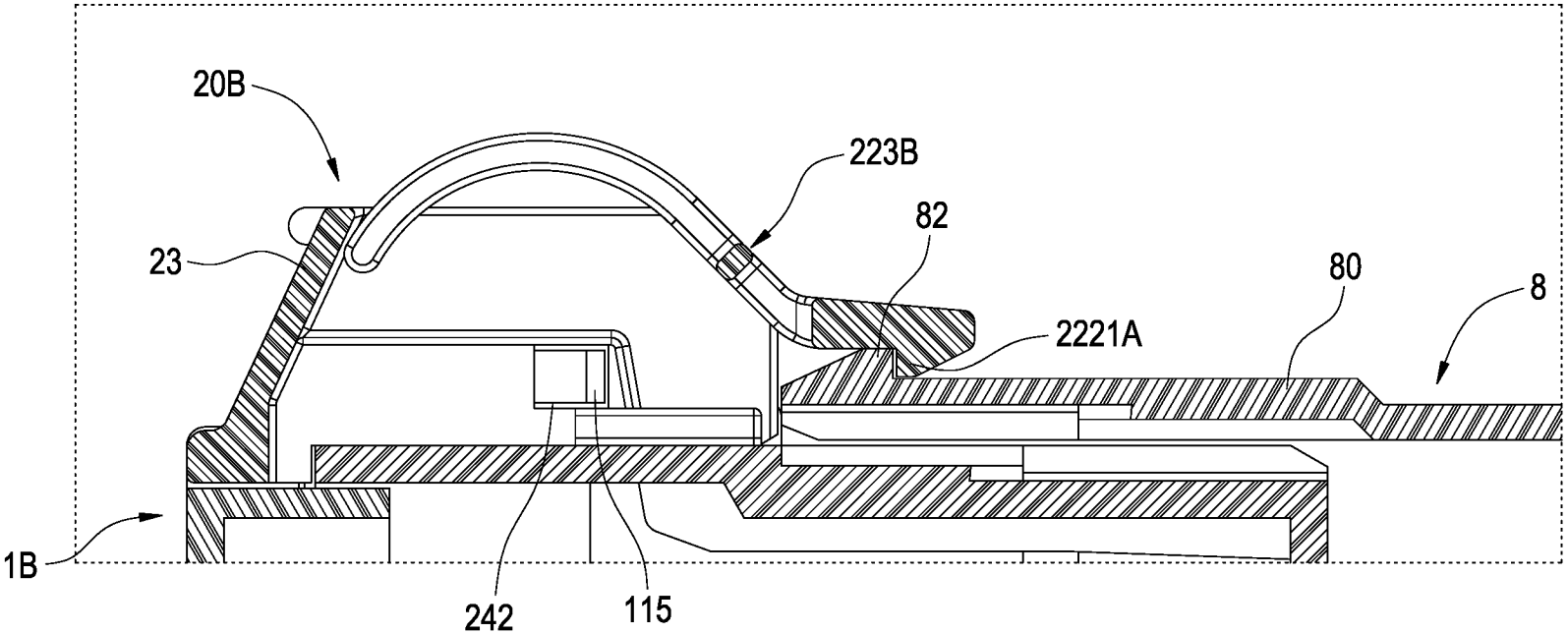
FIG. 11 is a cross sectional view showing the assembly of the terminal block structure and the engaging connector according to one another embodiment of the present disclosure.

Please refer to FIG. 10 and FIG. 11, which disclose one another embodiment of the present disclosure. A terminal block structure 1B disclosed in the one another embodiment shown from FIG. 10 and FIG. 11 is mainly the same as the-above-mentioned terminal block structure 1A disclosed in the another embodiment shown from FIG. 4 to FIG. 7, and the insulating housings 10 disclosed in the two embodiments are the same. The same as the unbuckling unit 20A, the base member 21 of an unbuckling unit 20B has the front plate 23, the lateral plates 24, the mounting slots 241, the recessed slots 242 and the buckling unit 2221A. The difference between the two embodiments is that a rotary part 223B has two deformable segments 2231 formed at two lateral sides, where the first arm part 221 and the second arm parts 222 are connected, and connected to each of the lateral plates 24, thus the rotary member 22 rotates about each of the deformable segments 2231 of the rotary part 223B as a rotation center.

While this disclosure has been described by means of specific embodiments, numerous modifications and variations could be made thereto by those skilled in the art without departing from the scope and spirit of this disclosure set forth in the claims.

What is claimed is:

1. An unbuckling unit, comprising:

a base member; and a rotary member, operably connected to the base member, and comprising a first arm part, a second arm part extended from the first arm part and a rotary part disposed between the first arm part and the second arm part, wherein the second arm part comprises a buckling unit, and the rotary part is connected to the base member;

wherein, when the first arm part is applied with an external force, the rotary member rotates about the rotary part as a rotation center to drive the second arm part to ascend;

wherein the base member comprises a U-shaped rack, the rotary part comprises a plurality of deformable segments, each of the deformable segments is disposed at a junction location of the first arm part and the second arm part and connected to the U-shaped rack.

2. The unbuckling unit according to claim 1, wherein the first arm part and the second arm part are a rigid component respectively.

3. The unbuckling unit according to claim 1, wherein the base member and the rotary member are integrally formed.

4. The unbuckling unit according to claim 1, wherein the buckling unit is a buckle block or a buckle slot.

5. A terminal block structure, used to be connected to an engaging connector, the engaging connector comprising a buckled unit, and the terminal block structure comprising:

an insulating housing; and at least one unbuckling unit, fastened on the insulating housing and comprising a base member and a rotary member, wherein the rotary member is operably connected to the base member, the rotary member comprises a first arm part, a second arm part extended from the first arm part and a rotary part disposed between the first arm part and the second arm part, the second arm part comprises a buckling unit, and the rotary part is connected to the base member;

wherein, when the first arm part is applied with an external force, the rotary member rotates about the rotary part as a rotation center to drive the second arm part to ascend to make the buckling unit and the buckled unit be unbuckled;

wherein the insulating housing comprises a seat member and a plurality of insertion blocks extended from the seat member, a plurality of buckle hooks is extended from the seat member, the base member comprises a U-shaped rack, and the U-shaped rack comprises a plurality of latching strips disposed therein and respectively latched and positioned with the buckle hooks.

6. The terminal block structure according to claim 5, wherein the seat member comprises a plurality of hook arms extended therefrom, the engaging connector comprises a plurality of another buckled units, each of the hook arms is correspondingly latched and positioned with each of the another buckled units.

7. A terminal block structure, used to be connected to an engaging connector, the engaging connector comprising a buckled unit, and the terminal block structure comprising:

an insulating housing; and at least one unbuckling unit, fastened on the insulating housing and comprising a base member and a rotary member, wherein the rotary member is operably connected to the base member, the rotary member comprises a first arm part, a second arm part extended from the first arm part and a rotary part disposed between the first arm part and the second arm part, the second arm part comprises a buckling unit, and the rotary part is connected to the base member;

wherein, when the first arm part is applied with an external force, the rotary member rotates about the rotary part as a rotation center to drive the second arm part to ascend to make the buckling unit and the buckled unit be unbuckled;

wherein the insulating housing comprises a seat member and a plurality of insertion blocks extended from the seat member, the seat member comprises a notch, and the unbuckling unit is disposed corresponding to the notch.

8. The terminal block structure according to claim 7, wherein the seat member comprises a plurality of guiding strips disposed in the notch, the base member of the unbuckling unit comprises a front plate and a lateral plate respectively connected to two ends of the front plate, and each of the lateral plates is correspondingly clamped and fastened with each of the guiding strips.

9. The terminal block structure according to claim 8, wherein the seat member further comprises a plurality of protrusions and a plurality of mounting strips disposed in the notch, each of the lateral plates comprises a mounting slot and a recessed slot, each of the mounting strips is accommodated in each of the mounting slots and each of the protrusions is latched and positioned in each of the recessed slots.

* * * * *